US009112297B2

(12) United States Patent
Iwasawa et al.

(10) Patent No.: US 9,112,297 B2
(45) Date of Patent: Aug. 18, 2015

(54) CONNECTOR HAVING TERMINAL ACCOMMODATING CHAMBERS

(75) Inventors: Hidehiko Iwasawa, Shizuoka (JP); Tohru Kurosawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/235,816

(22) PCT Filed: Aug. 7, 2012

(86) PCT No.: PCT/JP2012/005007

§ 371 (c)(1), (2), (4) Date: Jan. 29, 2014

(87) PCT Pub. No.: WO2013/021624

PCT Pub. Date: Feb. 14, 2013

(65) Prior Publication Data

US 2014/0194001 A1 Jul. 10, 2014

(30) Foreign Application Priority Data

Aug. 8, 2011 (JP) ..... 2011-172850

(51) Int. Cl.

*H01R 13/10* (2006.01)
*H01R 13/52* (2006.01)
*H01R 13/443* (2006.01)

(52) U.S. Cl.

CPC ..... *H01R 13/5202* (2013.01); *H01R 13/5219* (2013.01); *H01R 13/443* (2013.01)

(58) Field of Classification Search

CPC ..... H01R 13/11; H01R 23/725; H01R 23/02; H01R 13/112; H01R 13/113; H01R 13/5216; H01R 13/52; H01R 13/405; H01R 4/70; H01R 11/281; H01R 13/521; H01R 13/5219; H01R 13/5205; H01R 13/5208

USPC ..... 439/682, 519, 587

See application file for complete search history.

(56) References Cited

U.S. PATENT DOCUMENTS 2,881,406 A * 4/1959 Arson ..... 439/589
4,984,973 A * 1/1991 Itameri-Kinter et al. ..... 417/422

(Continued)

FOREIGN PATENT DOCUMENTS

EP 1065757 A2 1/2001
JP H11-354201 A 12/1999

(Continued)

OTHER PUBLICATIONS

Japanese office action letter issued on Mar. 17, 2015 in the counterpart Japanese patent application.

(Continued)

*Primary Examiner* — Abdullah Riyami
*Assistant Examiner* — Vladimir Imas
(74) *Attorney, Agent, or Firm* — Marvin A. Motsenbocker; Mots Law, PLLC

(57) ABSTRACT

A female connector housing is provided with a plurality of terminal accommodating chambers. Each of the terminal accommodating chambers is provided, on its front face, with a terminal insertion opening through which a male terminal is to be inserted. Each of the terminal accommodating chambers is provided, on its rear face, with a wire withdrawal opening. In the terminal accommodating chamber which is intended to accommodate no terminal, there are provided a first shielding wall which surrounds an erroneous-insertion allowable space allowing the male terminal to be inserted erroneously and shields the interior of the erroneous-insertion allowable space and a second shielding wall for shielding the wire withdrawal opening.

1 Claim, 6 Drawing Sheets

(56) References Cited

U.S. PATENT DOCUMENTS

| | | | | |
|---|---|---|---|---|
| 5,498,166 | A * | 3/1996 | Rothenberger | 439/66 |
| 5,580,282 | A * | 12/1996 | Paterek | 439/685 |
| 5,836,789 | A * | 11/1998 | Kourimsky et al. | 439/604 |
| 6,247,965 | B1 | 6/2001 | Cummings et al. | |
| 6,254,424 | B1 | 7/2001 | Murakami et al. | |
| 6,431,922 | B1 * | 8/2002 | Ko | 439/748 |
| 6,752,644 | B2 * | 6/2004 | Shibata | 439/271 |
| 6,837,744 | B2 * | 1/2005 | To et al. | 439/587 |
| 6,913,493 | B2 * | 7/2005 | Berg et al. | 439/736 |
| 6,986,677 | B2 * | 1/2006 | Janssen | 439/275 |
| 7,347,704 | B2 * | 3/2008 | Tsuji | 439/159 |
| 7,530,843 | B1 * | 5/2009 | Tesfay et al. | 439/587 |
| 7,722,414 | B2 * | 5/2010 | Tanaka et al. | 439/757 |
| 7,744,411 | B2 * | 6/2010 | Casses et al. | 439/587 |
| 7,819,695 | B2 * | 10/2010 | Sasaki et al. | 439/595 |
| 7,922,530 | B2 * | 4/2011 | Chazottes et al. | 439/587 |
| 7,950,962 | B2 * | 5/2011 | Mase et al. | 439/587 |
| 8,668,509 | B2 * | 3/2014 | Chaize | 439/271 |
| 2002/0064989 | A1 | 5/2002 | Sato et al. | |
| 2009/0191767 | A1 * | 7/2009 | Mase et al. | 439/752 |
| 2014/0194001 | A1 * | 7/2014 | Iwasawa et al. | 439/587 |

FOREIGN PATENT DOCUMENTS

| | | | |
|---|---|---|---|
| JP | 2006-324161 | A | 11/2006 |
| JP | 2010-027317 | A | 2/2010 |
| JP | 2010-027507 | A | 2/2010 |

OTHER PUBLICATIONS

Korean office action letter issued on Nov. 24, 2014 in the counterpart Korean patent application.

* cited by examiner

CONNECTOR HAVING TERMINAL ACCOMMODATING CHAMBERS

TECHNICAL FIELD

The present invention relates to a connector using terminal accommodating chambers whose number is smaller than the maximum number of settable terminals to be accommodated in the connector.

BACKGROUND ART

For instance, connectors for use under an oil environment are required to have structures resistive to contaminations. Patent Literature No. 1 (PLT1) discloses a connector device as the representative of such conventional connector devices.

This prior art connector device 100 comprises a male terminal connector 101 and a female terminal connector 110. The male terminal connector 101 includes a male terminal connector housing 102 having a mating connector fitting chamber 103 whose front face is opened, and a plurality of male terminals 104 secured in the male terminal connector housing 102. In the male terminals 104, their respective tips are arranged to project in the mating connector fitting chamber 103 at regular intervals.

The female terminal connector 110 includes a female terminal connector housing 111 having a plurality of terminal accommodating chambers 112 and a plurality of female terminals 113 accommodated in the respective terminal accommodating chambers 112. The respective terminal accommodating chambers 112 are partitioned by an outer wall 111*a* and partition walls 111*b*, respectively. Each terminal accommodating chamber 112 is provided, on its front face, with a terminal insertion opening 114 into which the mating male terminal 104 is inserted. Each terminal accommodating chamber 112 is also provided, on its rear face, with a wire withdrawal opening 115 from which a wire (not shown) is withdrawn outside. Further, front faces of the outer wall 111*a* and the partition walls 111*b* surrounding the respective terminal insertion openings 114 are adapted so as to abut against far walls 102*a* of the mating connector fitting chamber 103 of the male terminal connector housing 102 when the female terminal connector 110 is fitted to the male terminal connector housing 102.

In the above constitution, since the outer wall 111*a* and the partition walls 111*b* forming the peripheries of the respective terminal insertion openings 114 of the female terminal connector housing 111 abut against the far walls 102*a* of the male terminal connector housing 102 under a connector fitting condition, the adjoining terminal accommodating chambers 112 are not communicated with each other through the terminal insertion openings 114 and a front gap. In addition, the respective wire withdrawal openings 115 of the female terminal connector housing 111 are generally sealed up with rubber plugs (not shown) fitted on the outer circumferences of the wires. In this way, the terminal accommodating chambers 112 are shielded to prevent pollution dispersion of contaminants into the terminal accommodating chambers 112, as much as possible.

Meanwhile, the connector device 100 may be brought into a condition of using only the terminal accommodating chambers 112 whose number is less than the maximum number of settable terminal accommodating chambers. In such a situation, hole caps may be fitted into unused terminal accommodating chambers 112 or dummy terminals crimping short wires may be accommodated in the unused terminal accommodating chambers 112. In this way, by preventing the contaminants from entering the nonuse terminal accommodating chambers 112 as possible, diffusion of the contaminants into the connector device 100 is avoided. The inside diffusion of contaminants into the female terminal connector housing 111 may cause any problem, such as short-circuit.

CITATION LIST

Patent Literature

[PTL 1]
Japanese Patent Publication Laid-open No. 2010-27507

SUMMARY OF INVENTION

Under the condition of using terminal accommodating chambers whose number is smaller than the maximum number of settable terminal accommodating chambers, however, countermeasures with the fitting of hole caps or the accommodation of dummy terminals against the entry of contaminants are not only troublesome in labor but also wasteful in cost of required components.

While preventing contaminant entry through the wire withdrawal openings 115, the provision of hole caps etc. cannot prevent contaminant entry into the empty terminal accommodating chambers 112 through an engagement gap between the female terminal connector housing 111 and the male terminal connector housing 102. As the contaminants entering the empty terminal accommodating chambers 112 gets into the terminal insertion openings 114 with ease, it is impossible to prevent contaminant diffusion in the connector device 100 effectively.

Here, it might be expected to provide a shielding wall so as to shield the terminal insertion openings 114 of the empty terminal accommodating chambers 112. However, if the male terminal 104 is inserted into the empty terminal accommodating chamber 112 by mistake, then the male terminal 104 is subjected to damage, such as deflection, by the shielding wall.

In order to solve the above-mentioned problems, therefore, an object of the present invention is to provide, under the condition of using terminals whose number is smaller than the maximum number of settable terminals, a connector that can prevent contaminant diffusion from a nonuse terminal accommodating chamber without using a different component as much as possible and that would not cause damage, such as deflection, to a mating terminal even if it is inserted into the nonuse terminal accommodating chamber erroneously.

In order to attain the above object, according to the present invention, there is provided a connector comprising: a connector housing having a plurality of terminal accommodating chambers partitioned by partition walls formed in the connector housing, wherein each of the terminal accommodating chambers is provided, on one face thereof in a longitudinal direction of the terminal accommodating chamber, with a terminal insertion opening through which a mating terminal is to be inserted and is provided, on the other face in the longitudinal direction, with a wire withdrawal opening through which a wire is withdrawn, the plurality of terminal accommodating chambers comprise at least one first terminal accommodating chamber intended to accommodate a terminal therein and at least one second terminal accommodating chamber intended to accommodate no terminal therein, and the connector housing is provided, in the second terminal accommodating chamber, with: a first shielding wall which defines an erroneous-insertion allowable space for allowing the mating terminal to be inserted into the second terminal accommodating chamber erroneously; and a second shielding wall arranged between the first shield wall and the wire withdrawal opening.

According to the present invention, even if contaminants enter a terminal accommodating chamber having no terminal accommodated therein through an engagement gap of a connector housing, contaminant entry into the terminal insertion opening is blocked by the first shielding wall. Also, contaminant entry from the wire withdrawal opening into the terminal accommodating chamber is blocked, so that the contaminants do not enter the terminal insertion opening. From above, under the condition of using terminals whose number is smaller than the maximum number of sellable terminals, it is possible to a prevent contaminant diffusion from the nonuse terminal accommodating chamber into the connector housing without using a different component as much as possible.

In addition, even if a mating terminal is inserted into the nonuse terminal accommodating chamber erroneously, there is no possibility that the mating terminal is subjected to damage due to such an erroneous insertion, such as deflection, because the insertion of the mating terminal is permitted by the connector.

DESCRIPTION OF EMBODIMENTS

An embodiment of the present invention will be described with reference to drawings below.

Figure 1:
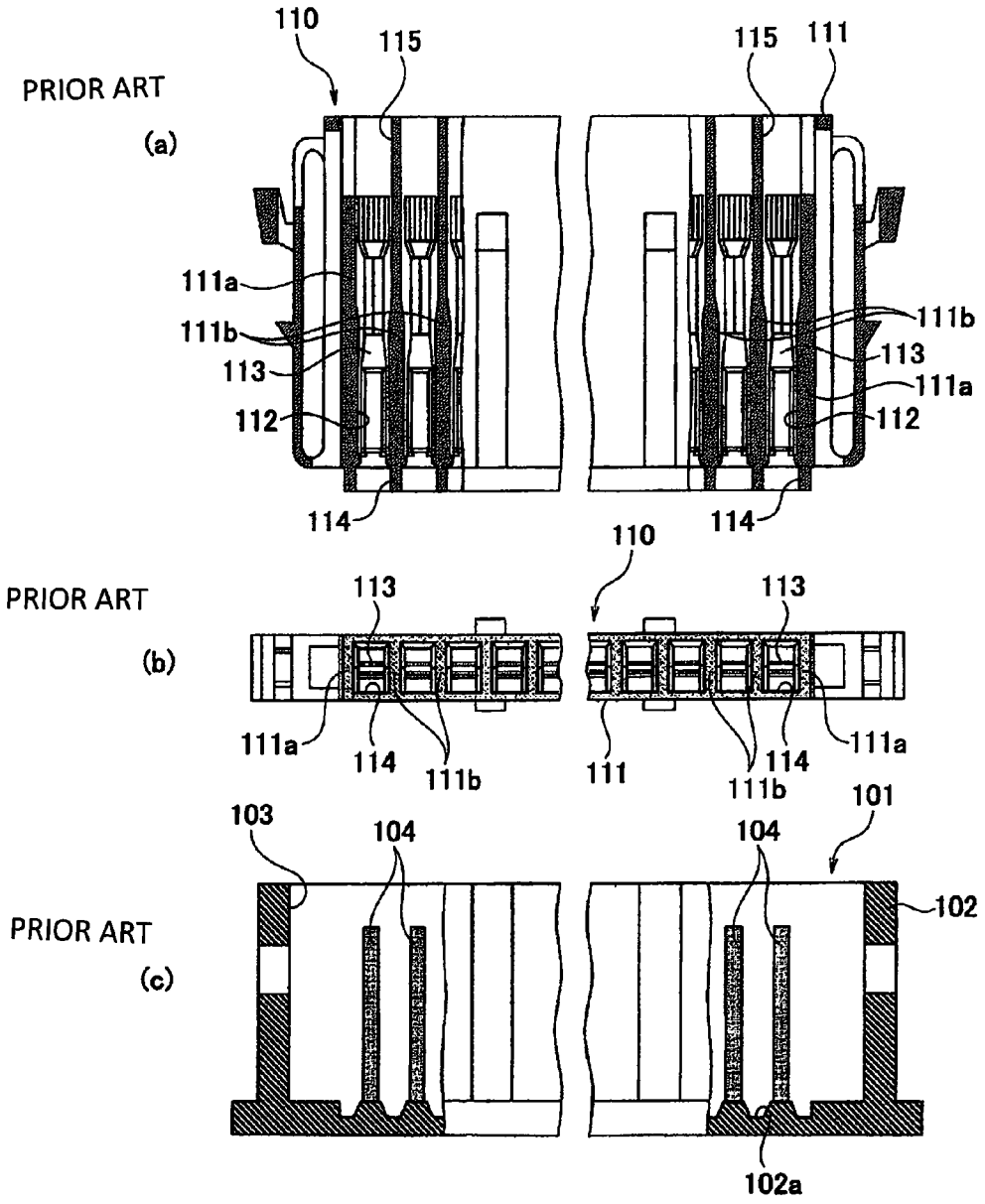
FIG. 1 shows prior art figures in which FIG. 1(*a*) is a cross sectional view of a female terminal connector, FIG. 1(*b*) is a front view of the female terminal connector and FIG. 1(*c*) is a cross sectional view of a male terminal connector.
Figure 2:
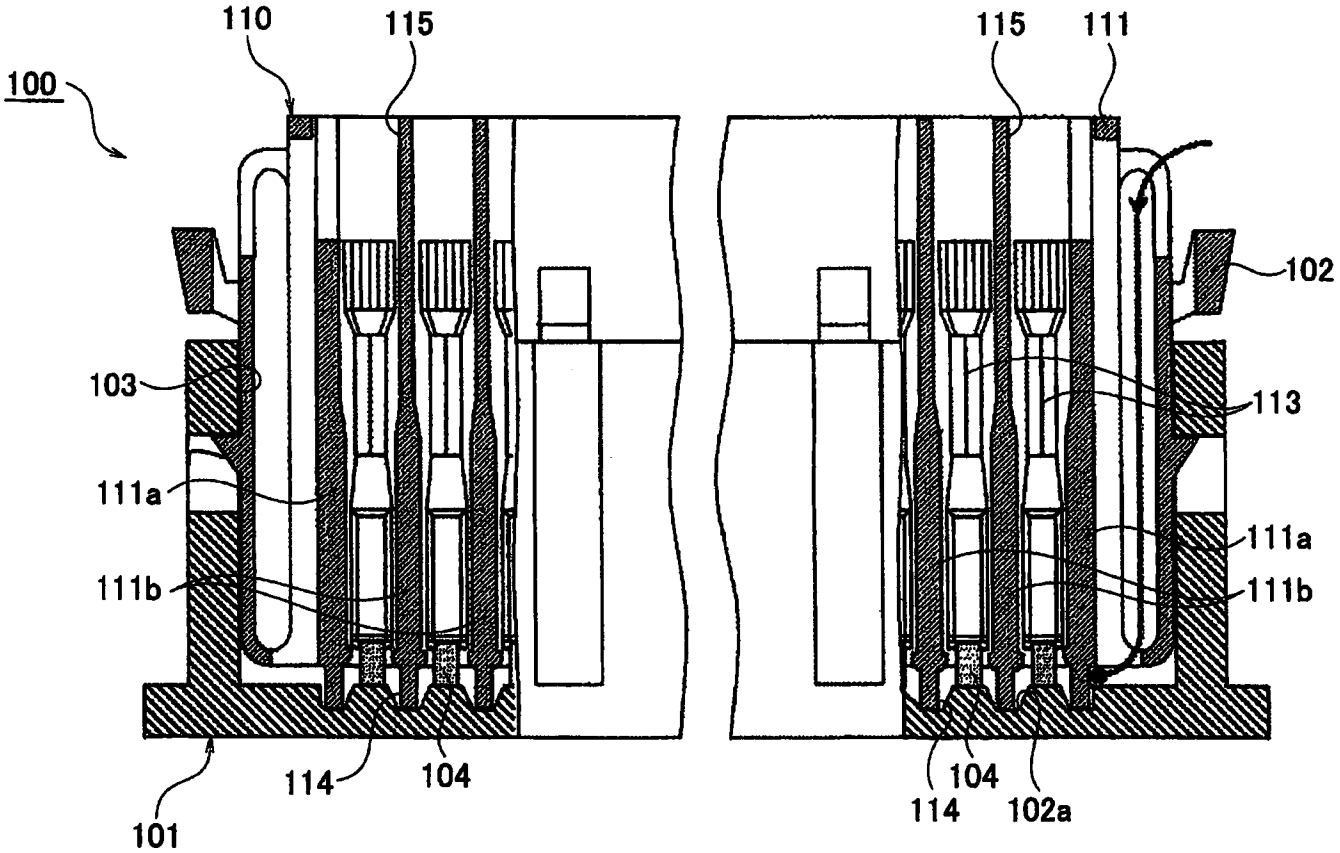
Fig. 2 PRIOR ART
FIG. 2 is a sectional view of a prior art connector device under its fitted condition.
Figure 3:
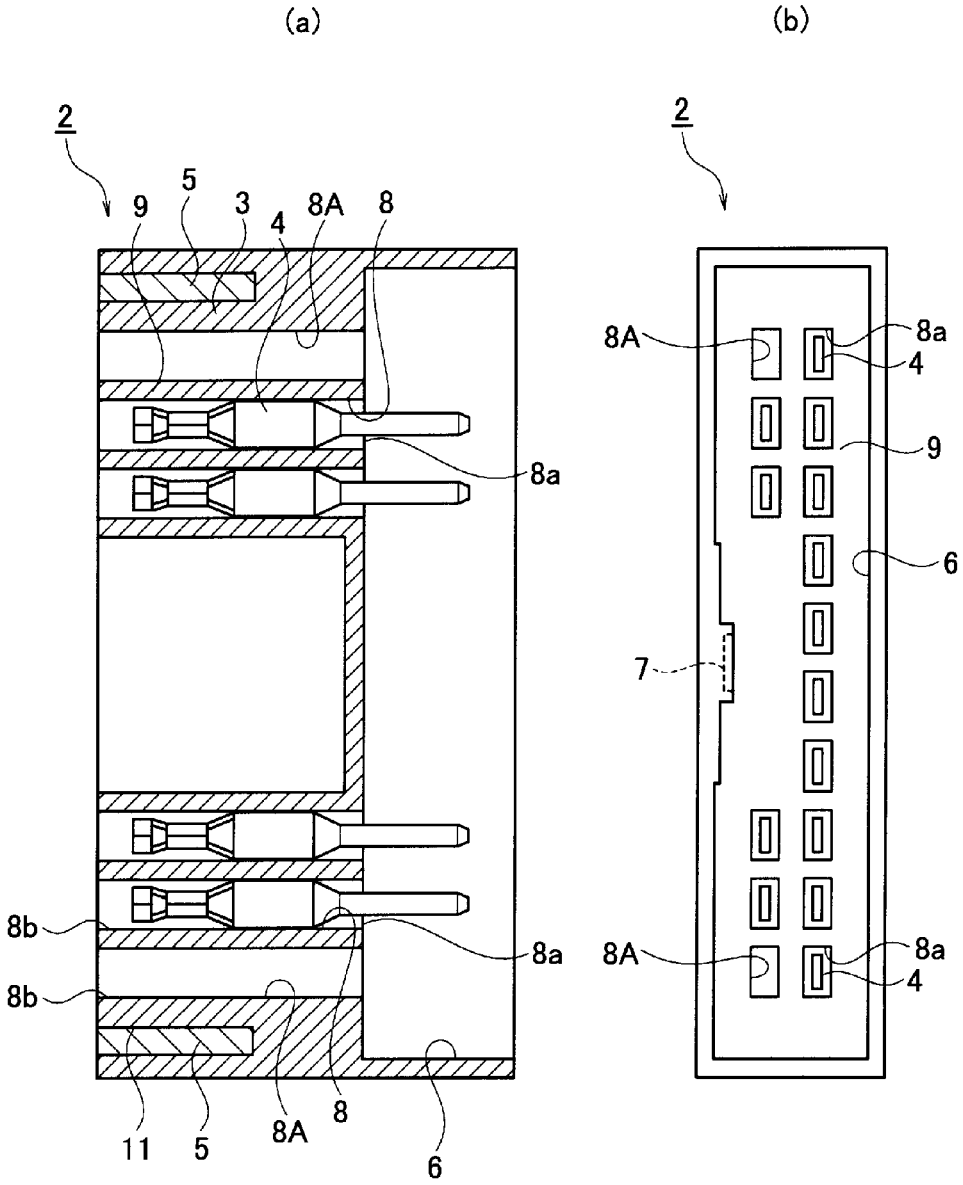
FIG. 3 shows an embodiment of the present invention, in which FIG. 3(*a*) is a cross sectional view of a male terminal connector and FIG. 3(*b*) is a front view of the male terminal connector.
Figure 4:
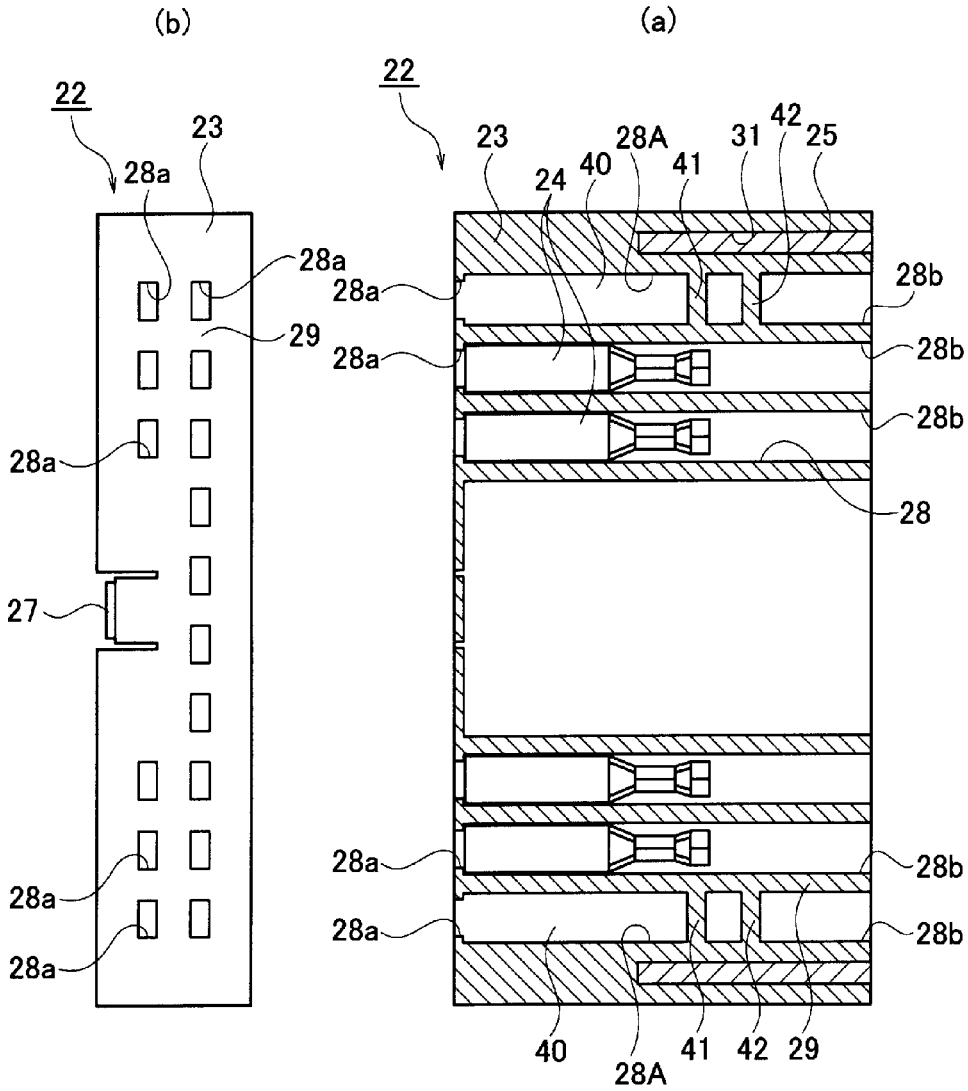
FIG. 4 shows an embodiment of the present invention, in which FIG. 4(*a*) is a cross sectional view of a female terminal connector and FIG. 4(*b*) is a front view of the female terminal connector.
Figure 5:
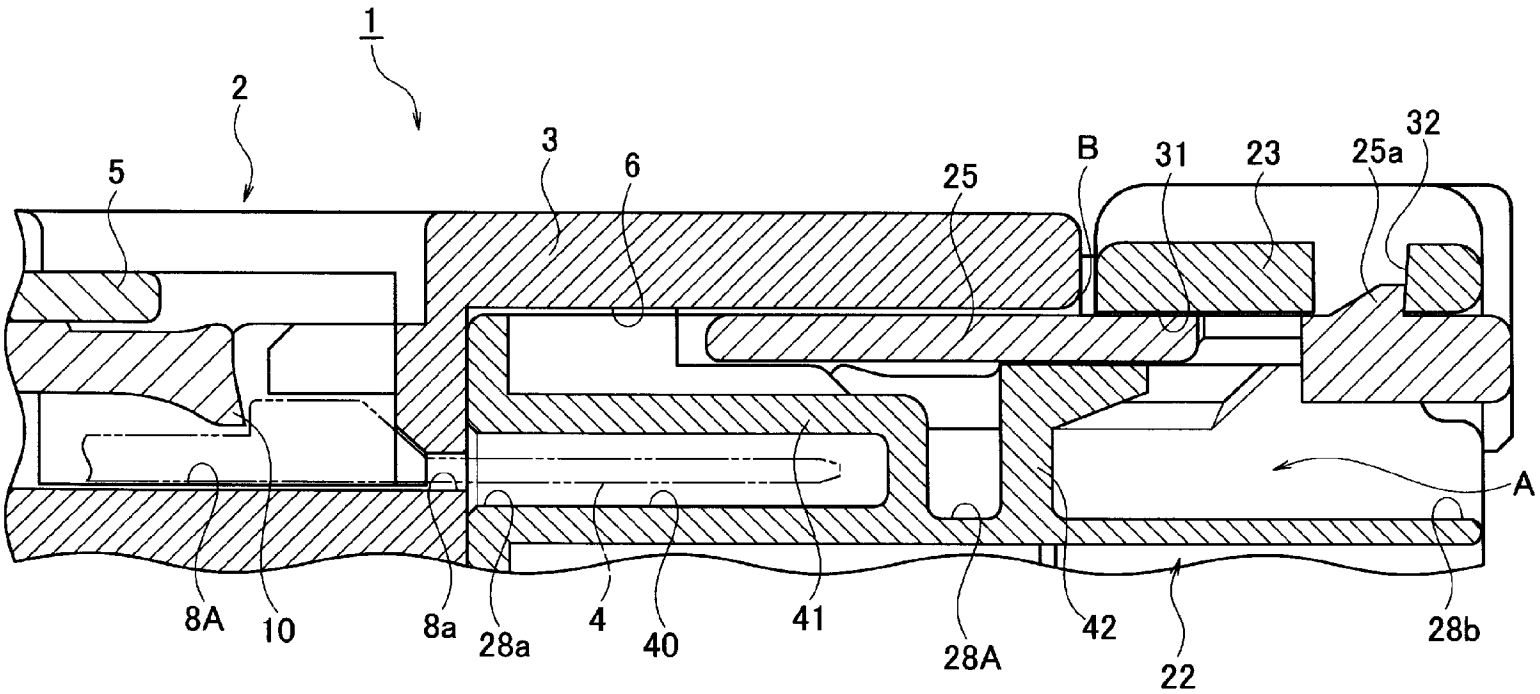
FIG. 5 is a longitudinal sectional view of an essential part of the connector device under its fitted condition, showing an embodiment of the present invention.

FIGS. 3 to 5 show one embodiment of the present invention. As shown in FIGS. 3 and 4, the connector device 1 comprises a male terminal connector 2 and a female terminal connector 22 as a connector in accordance with the present invention.

The male terminal connector 2 includes a male terminal connector housing 3, a plurality of male terminals 4 accommodated in the male terminal connector housing 3 and a rear holder 5 slidably fitted to the male terminal connector housing 3.

The female terminal connector housing 3 is provided with a mating connector fitting chamber 6. The front face of the mating connector fitting chamber 6 is opened to its outside. The mating connector fitting chamber 6 is provided, on an inner wall of the top face side, with a connector lock groove 7.

The male terminal connector housing 3 is provided with a plurality of terminal accommodating chambers 8 in two stages. In each stage, the adjoining terminal accommodating chambers 8 are partitioned by the partition walls 9. In this example, the male terminal connector housing 3 is characterized by "16" in the maximum number of settable terminals, with the arrangement of ten terminal accommodating chambers 8 in the lower stage and six terminal accommodating chambers 8, 8A in the upper stage. In each terminal accommodating chamber 8, a lance 10 capable of elastic deformation is formed to project into the chamber. Respective lances 10 are formed integrally with the male terminal connector housing 3. Terminal projecting ports 8*a* are arranged on respective front faces of the terminal accommodating chambers 8, 8A. These respective terminal projecting openings 8*a* open into the mating connector fitting chamber 6. The respective terminal accommodating chambers 8, 8A are provided, on their rear faces, with wire withdrawal openings 8*b*, respectively.

In a view from the backside of the male terminal connector housing 3, it has a holder slide groove 11 formed over the whole area of an outer circumference of the housing 3.

The male terminals 4 are accommodated in the respective terminal accommodating chambers 8 except for the outermost terminal accommodating chambers 8A on left and right ends of the upper stage. The terminal accommodating chambers 8A on left and right ends of the upper stage constitute unused "empty" chambers. That is, the male terminal connector 2 is a connector (14-pins) using the terminal accommodating chambers whose number is less than the maximum number of settable terminal accommodating chambers (16-pins). The respective male terminals 4 are inserted into the respective terminal accommodating chambers 8 through the wire withdrawal openings 8*b*. When the male terminals 4 are inserted up to their insertion completing positions, the respective lances 10 are elastically deformed and engaged in the male terminals 4. Consequently, the male terminals 4 are prevented from moving to a withdrawal direction of the wires. The leading ends of the male terminals 4 project into the mating connector fitting chamber 6 through the terminal projecting openings 8*a*, respectively. The respective terminals 4 are connected to ends of wires (not shown). The wires are withdrawn to outside through the wire withdrawal openings 8*b*, respectively. The wires are equipped, on their peripheries, with rubber plugs (not shown). The wire withdrawal openings 8*b* are sealed up with these rubber plugs. In this way, the connector is constructed so as to prevent contaminant entry into the terminal accommodating chambers 8 through the wire withdrawal openings 8*b*.

The rear holder 5 is in the form of a substantially-rectangular frame. The rear holder 5 is sliding-inserted into a holder slide groove 11 from the rear side of the male terminal connector housing 3. When the rear holder 5 is in a sliding completing position, a locking claw 5*a* is locked in a locking groove 12 of the male terminal connector housing 3. The rear holder 5 at the sliding completing position restricts the movement of the respective lances 5 in the direction for releasing.

The female terminal connector 22 includes a female connector housing 23, a plurality of female terminals 24 accommodated in the female terminal connector housing 23 and a rear holder 25 sliding-fitted to the female connector housing 23.

The female terminal connector 22 is provided, on the top face side, with a connector lock arm 27. The connector lock arm 27 is equipped with a locking projection 27*a* and a pressure operating part 27*b*.

The female terminal connector housing 23 has a plurality of terminal accommodating chambers 28, 28A formed in upper and lower stages. In each stage, the adjoining terminal accommodating chambers 28, 28A are partitioned by a partition wall 29. The female terminal connector housing 23 is constructed so as to accommodate 16 (sixteen) terminals at a maximum, with the arrangement of 10 (ten) terminal accommodating chambers 28 on the lower stage and 6 (six) terminal accommodating chambers 28, 28A on the upper stage. Elastically-deformable lances 30 are arranged so as to project into the terminal accommodating chambers 28, respectively. The respective lances 30 are formed integrally with the female terminal connector housing 23. On the front faces of the respective terminal accommodating chambers 28, 28A, there are respectively provided terminal insertion openings 28*a* into which the male terminals 4 as the mating terminals are inserted. These respective terminal insertion openings 28*a* open at the front face of the female terminal connector housing 23. The terminal accommodating chambers 28, 28A are provided, at their rear faces, with wire withdrawal openings 28*b*, respectively.

In a view from the backside of the female terminal connector housing 23, it has a holder slide groove 31 formed over the whole area of an outer circumference of the housing 23.

The female terminals 24 are accommodated in the respective terminal accommodating chambers 28 except the terminal accommodating chambers 28A on left and right sides of the upper stage. The terminal accommodating chambers 28A on left and right sides of the upper stage are unused "empty" chambers. That is, the female terminal connector 22 is a connector (14-pins) using terminals whose number is less than the maximum number of settable terminals (16-pins). The respective female terminals 24 are inserted into the terminal accommodating chambers 28 through the wire withdrawal openings 28*b*, respectively. Once each terminal is inserted up to the insertion completing position, each lance 30 returns in elastic deformation and is engaged in the terminal accommodating chamber. Consequently, the respective female terminals 24 are prevented from moving in the direction to withdraw the wires. The respective female terminals 24 are connected to respective ends of the wires (not shown). The respective wires are drawn out through the wire withdrawal openings 28*b*. The wires are equipped, on their peripheries, with rubber plugs (not shown). The wire withdrawal openings 28*b* are sealed up with these rubber plugs. In this way, the connector is constructed so as to prevent contaminant entry into the terminal accommodating chambers 28 through the wire withdrawal openings 28*b*.

The rear holder 25 is in the form of a substantially-rectangular frame. The rear holder 25 is sliding-inserted into a holder slide groove 31 from the rear side of the female terminal connector housing 23. When the rear holder 25 is in a sliding completing position, a locking claw 25*a* is locked in a locking groove 32 of the female terminal connector housing 23. At the sliding completing position, the rear holder 25 serves to restrict movements of the respective lances 30 in a direction for disengagement.

In the empty terminal accommodating chamber 28A, a first shielding wall 41 is arranged so as to surround an erroneous-insertion allowable space 40 allowing an insertion of the male terminal 4. The first shielding wall 41 serves to shield the interior of the erroneous-insertion allowable space 40. The empty terminal accommodating chamber 28A is also provided, behind the first shielding wall 41, with a second shielding wall 42. The second shielding wall 42 substantially shields the wire withdrawal opening 28*b*.

In the above-mentioned constitution, for instance, if the connecter device 1 is used in an oil environment, then the contaminants are apt to enter the connector device 1. For an entry pathway of contaminants in the female terminal connector housing 23, there could be expected a pathway extending from the wire withdrawal openings 28*b* having no wire (not shown) withdrawn to the empty terminal accommodating chambers 28A, as shown with arrow A of FIG. 5. However, as the contaminants gaining entry through this pathway are blocked by the second shielding walls 42, they cannot make inroad into the front side of the terminal accommodating chambers 28A. For an alternative entry pathway, as shown with arrow B of FIG. 5, there could be expected a pathway extending from an engagement gap between the male terminal connector housing 3 and the female terminal connector housing 23 to the empty terminal accommodating chambers 28A. However, the contaminants entering through this pathway cannot enter the erroneous-insertion allowable space 40 due to the first shielding wall 41, so that they cannot invade the terminal insertion opening 28*a* through the erroneous-insertion allowable space 40.

Figure 6:
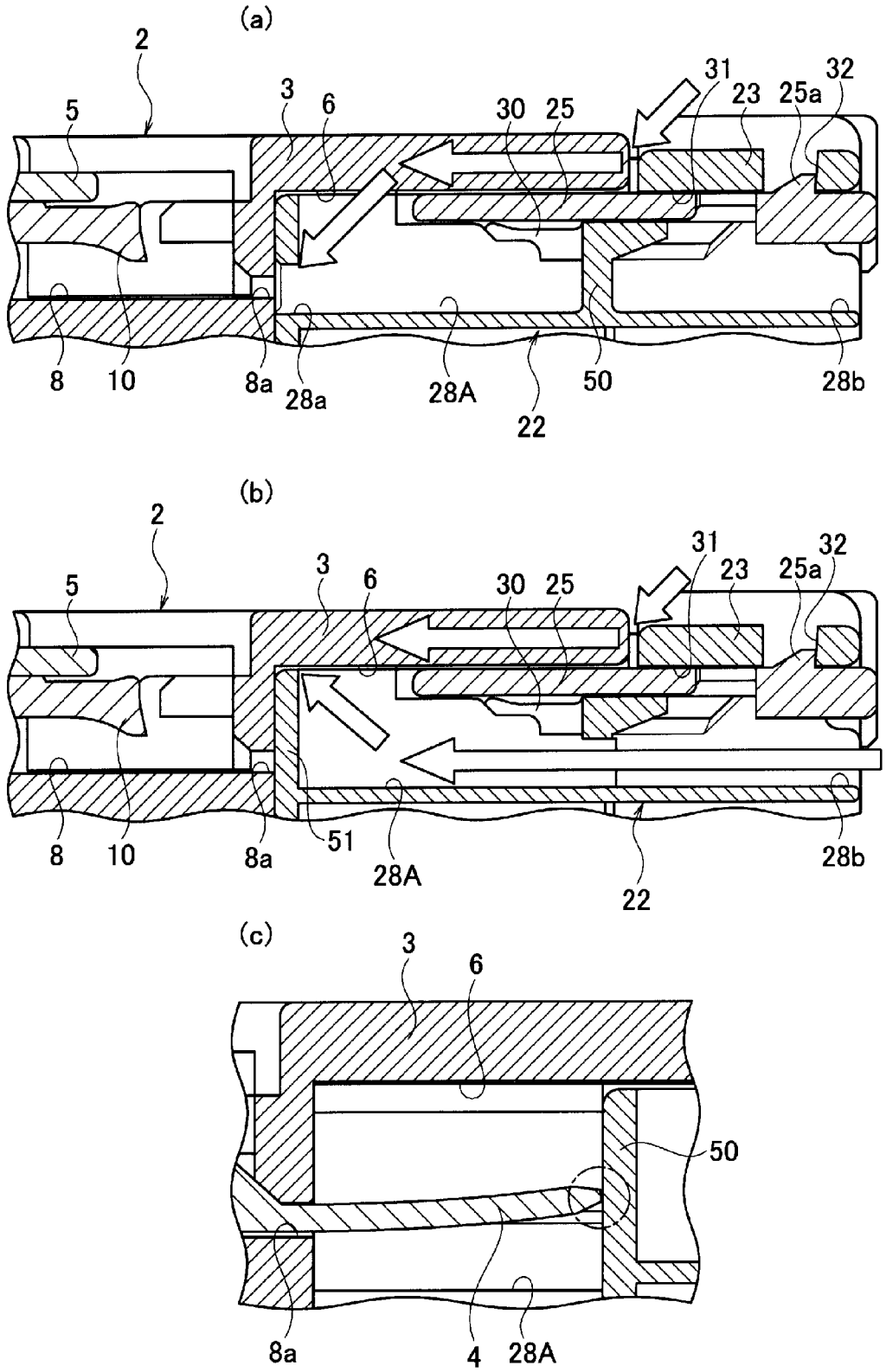
FIG. 6 shows a female terminal connector for comparison, in which FIG. 6(*a*) is a longitudinal sectional view of an essential part of the female terminal connector of a first comparison example, FIG. 6(*b*) is a longitudinal sectional view of an essential part of the female terminal connector of a second comparison example and FIG. 6(*c*) is a longitudinal sectional view of an essential part, showing a male terminal being inserted into the female terminal connector of the first comparison example by mistake.

Here, as shown in FIG. 6(*a*), it might be also expected to provide a shielding wall 50 simply partitioning the interior of the empty terminal accommodating chamber 28A in an anteroposterior direction in order to prevent an invasion of contaminants through the wire withdrawal opening 28*b*. However, as shown with arrows of FIG. 6(*a*), this arrangement allows the contaminants entering through the engagement gap of the female terminal connector housing 23 to invade the terminal insertion opening 28*a* through the empty terminal accommodating chamber 28A easily, causing a dispersion of contaminants in the connector device 1.

Alternatively, as shown in FIG. 6(*b*), it might be expected to block off the front side of the empty terminal accommodating chamber 28A with a shielding wall 51 so as to close up the terminal insertion opening 28*a*. However, as shown with arrows of FIG. 6(*b*), large amounts of contaminants can provide easy access to the vicinity of the front face of the empty terminal accommodating chamber 28A. The large amounts of contaminants invading in this way may diffuse into the connector device 1 through a clearance between the shielding wall 51 and an inner wall of the mating connector fitting chamber 6 of the male terminal connector housing 3 with ease.

In the female terminal connector 22 employing the number of terminals smaller than the maximum number of settable terminals inherent in the connector 22, it is possible to prevent the contaminants from diffusing into the connector device 1 due to their entry through the unused terminal accommodating chambers 28A as possible, without using any component as the conventional countermeasure. Due to nonuse of additional components as used in the conventional device, it is possible to restrain the total cost required to manufacture such a connector device 1 or a wire harness containing the connector device 1.

In addition, it is also envisaged that a connector using all the maximum number of settable terminals (i.e. 16 pins connector) is used for the male terminal connector 2 by mistake. However, as shown with a phantom line of FIG. 5, the male terminal 4 erroneously inserted into the empty terminal accommodating chamber 4 enters the erroneous-insertion allowable space 40 but does not abut against the first shielding wall 41. Accordingly, there is no possibility that the erroneously-inserted male terminal 4 is subjected to any damage, for example, deflection.

On the contrary, in the arrangement of FIG. 6(*b*) having the shielding wall 51, the erroneously-inserted male terminal 4 would be subjected to any damage, such as deflection, as a result of its collision with the shielding wall 51. Alternatively, in the arrangement of FIG. 6(*a*) having the shielding wall 50, the erroneously-inserted male terminal 4 will abut on the shielding wall 51 and successively have any damage such as deflection, as shown in FIG. 6(*c*).

As mentioned above, even if the male terminal 4 is inserted into the nonuse terminal accommodating chamber 28A erroneously, the female terminal connector 22 prevents the male terminal 4 from being subjected to any damage, such as deflection. In addition, it is possible to prevent contaminant diffusion into the connector device 1, which is derived from contaminant entry into the connector through nonuse terminal accommodating chambers 28A.

Although the present invention has been illustrated with an embodiment employing the male terminal connector 2 and the female terminal connector 22 for 14 pins (the number of terminals) in spite of their inherent structures for 16 pins at maximum, of course, the disclosed maximum number of settable terminals and the disclosed number of terminals on actual use are only illustrative and therefore, any number is applicable to each of these numbers.

INDUSTRIAL APPLICABILITY

As obvious from the above descriptions, according to the present invention, in a situation where a connector utilizes terminals whose number is smaller than the maximum number of settable terminals, it is possible to prevent contaminant diffusion through nonuse terminal accommodating chambers without using any additional components, as much as possible. Moreover, it is possible to provide a connector that could prevent a mating terminal from being subjected to any damage (e.g. deflection) even if the mating terminal is inserted into a nonuse terminal accommodating chamber erroneously.

The invention claimed is:

1. A connector comprising:

a connector housing having a plurality of terminal accommodating chambers partitioned by partition walls formed in the connector housing, wherein each of the terminal accommodating chambers is provided, on one face thereof in a longitudinal direction of the terminal accommodating chamber, with a terminal insertion opening through which a mating terminal is to be inserted and is provided, on the other face in the longitudinal direction, with a wire withdrawal opening through which a wire is withdrawn, the plurality of terminal accommodating chambers comprise at least one first terminal accommodating chamber intended to accommodate a terminal therein and at least one second terminal accommodating chamber intended to accommodate no terminal therein, and the connector housing is provided, in the second terminal accommodating chamber, with:

a first shielding wall which defines an erroneous-insertion allowable space for allowing the mating terminal to be inserted into the second terminal accommodating chamber erroneously; and a second shielding wall arranged between the first shield wall and the wire withdrawal opening.

* * * * *